United States Patent [19]

Jeter

[11] 3,967,680

[45] July 6, 1976

[54] METHOD AND APPARATUS FOR ACTUATING A DOWNHOLE DEVICE CARRIED BY A PIPE STRING

[75] Inventor: John Doise Jeter, Dallas, Tex.

[73] Assignee: Texas Dynamatics, Inc., Dallas, Tex.

[22] Filed: Aug. 1, 1974

[21] Appl. No.: 493,712

[52] U.S. Cl. ..... 166/250; 166/53; 166/226; 175/38; 175/48

[51] Int. Cl.[2] ..... E21B 23/04; E21B 3/12

[58] Field of Search ..... 175/24, 26, 38, 65, 175/40, 48, 55, 65; 166/53, 250, 226, 224 R; 73/151, 155

[56] References Cited

UNITED STATES PATENTS

| | | | |
|---|---|---|---|
| 3,039,543 | 6/1962 | Loocke | 175/38 X |
| 3,051,246 | 8/1962 | Clark, Jr. et al. | 166/226 |
| 3,324,717 | 6/1967 | Brooks et al. | 175/48 X |
| 3,780,809 | 12/1973 | Ayers, Jr. et al. | 166/53 X |
| 3,800,277 | 3/1974 | Patton et al. | 175/24 X |

*Primary Examiner*—Stephen J. Novosad

[57] ABSTRACT

A combination of means to detect rotation of a pipe string and means to detect flow of fluid through a pipe string is utilized to cause down hole apparatus to carry out preferred actions if the sequence of rotation rate change and flow rate change is of one character, other activities being carried out if different sequences occur. Alternately, a choice of several actions to be taken by down hole apparatus may be elected by sustaining a flow condition while rotational conditions are manipulated at the earth surface.

18 Claims, 14 Drawing Figures

METHOD AND APPARATUS FOR ACTUATING A DOWNHOLE DEVICE CARRIED BY A PIPE STRING

This invention relates to a method of and apparatus for selectively actuating one or more down hole devices carried by a pipe string extending into a well bore.

There is need from time to time in petroleum well related operations to cause a down hole device carried by a pipe string to do something or to stop doing something. For example, if a drill string includes a fluid motor, it may be desirable on occasion to lock the rotor of the motor to the stator so that the motor and the bit attached thereto can be rotated by the drill string. This is done in present operations by dropping a specially designed locking member down the bore of the pipe string so that it falls into position to lock the rotor and stator together. After the need for this has passed and it is desired to return to drilling operations, the locking member must be removed from the drill pipe either by fishing it out of the pipe with a wire line or by pulling the pipe out of the hole. Bendable subs used to deflect drilling motors from an existing bore hole direction are not rotated while bent, but may be rotated when straight. Such devices are now caused to bend by drilling fluid pressure, but may be constrained straight by a spear-like device dropped from the surface down the bore of the drill pipe before normal drilling begins. Here again, the spear-like device must be removed before deflection work can be resumed by using the bendable sub in the bent configuration.

There are advantages, in producing wells, in conducting some workover operations with the production tubing then deactivating down hole workover apparatus without removing the tubing from the well and allowing the well to produce through the tubing. Subsequent re-activation of the workover apparatus by the device of this invention, in some cases, will save tubing trip time.

In conventional rotary drilling and workover practices, three things can be conveniently controlled at the earth surface, both qualitatively and quantitatively, and occur at the bottom of the pipe string very nearly as they are caused at the earth surface. These are axial movement of the pipe, rotation of the pipe and the flow of fluid through the pipe. Rotation is readily detected by down hole devices. Flow of fluid through the pipe can also be readily detected; Therefore, it is an object of this invention to provide a method of and apparatus for actuation of a down hole device carried by the pipe string employing the rotation of the pipe and the pumping of fluid through the pipe for this purpose.

It is a further object of this invention to provide a method and apparatus for actuating a down hole device carried by a pipe string that is actuated when the rotation of the pipe and pumping of fluid through the pipe occurs in a preselected sequence, but is not actuated when the rotation and pumping of fluid occurs in other sequences.

It is a further object of this invention to provide a method of and apparatus for actuating a selected one of a plurality of down hole devices by manipulation of flow through the pipe in combination with manipulation of the pipe rotationally.

These and other objects, advantages and features of this invention will be apparent to those skilled in the art from a consideration of this specification, including the attached drawings and appended claims.

BRIEF DESCRIPTION OF DRAWINGS

In the drawings, wherein like reference characters are used throughout to designate like parts.

DETAILED DESCRIPTION OF DRAWINGS

In accordance with the method and apparatus of this invention, means are provided to detect the rate of rotation of a pipe string and to detect the rate of flow of fluid through the pipe string associated with means to carry out selected actions down hole in response to the sequence of rotation and flow changes caused by actions at the earth surface.

Figure 1:
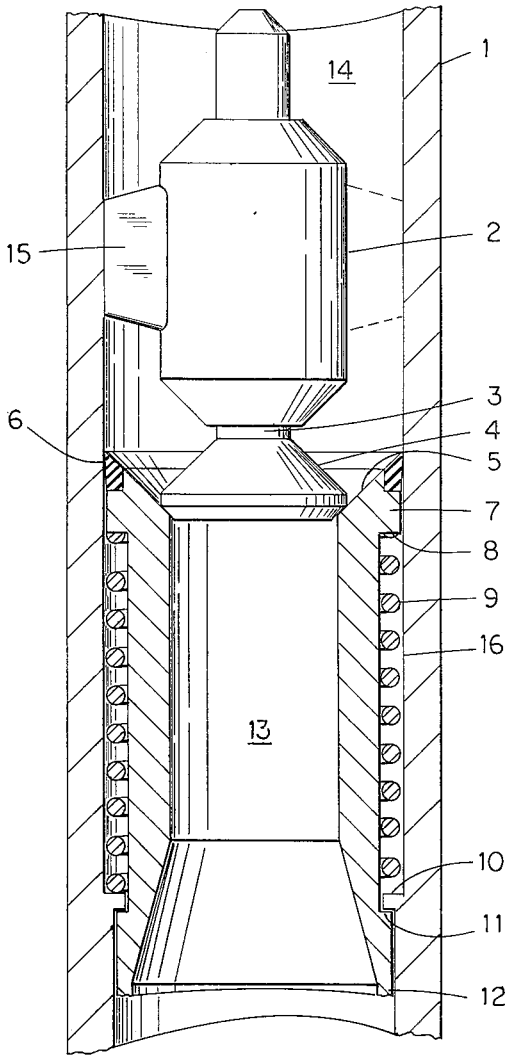
FIG. 1 is a longitudinal view partly in section and partly in elevation of an embodiment of this invention.

The preferred embodiment of this invention is shown in FIG. 1. An actuating member (actuator) 7 is slidably situated in the bore 16 of housing 1. Housing 1 is a continuation of a drill string being attached at the top by means (not shown) to the upwardly extending drill string and attached below to the downwardly extending drill string. The actuator 7 has extension 12 shown broken away which will transmit the axial motion of the actuator to any device that can be served by axial motion. Drilling fluid moving down the drill string will enter bore 14 and, acting against the upper seat surface 5 of actuator 7, wll cause a pressure differential between the top and bottom of the actuator and will force the actuator downwardly away from member 4 until the surface 5 is moved away from valve member 4 an amount related to flow rate. Fluid then flows between surface 5 and valve member 4 to enter bore 13 of actuator 7 and flow downward. Rotation sensor 2 will sense the rotation rate of the drill string by processes to be described relative to FIG. 7 and will control the distance that member 4 will follow surface 5 in its downward movement and thereby establish the downward distance that actuator 7 will move before separation of surface 5 and member 4 begins in response to the flow of drilling fluid down the drill string bore. Although the separation of surface 5 and member 4 varies with flow, the variation is small compared with the axial excursion of member 4 between the upper and lower positions. Extension 12, then, is regarded as having two positions, an upper position and a lower position.

The rotation sensor 2 is positioned within bore 14 by spiders 15. Actuator 7 has seals 6 in contact with bore 16 to prevent leakage of drilling fluid along the outside of the actuator. Spring 9 urges the actuator upwardly to its limit of travel when no drilling fluid is moving down the bore. The upper limit of travel of the actuator is established by the shoulder 11 on the actuator which abuts the annular ring 10 in the bore of housing 1.

FIGS. 2 through 6 show the cooperation between member 4, which is the output element of the rotation sensor 2, and member 7 which operates as a flow detector.

Figure 2:
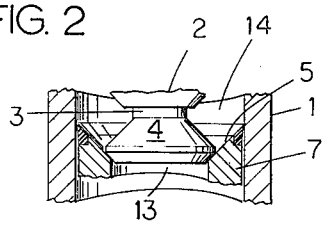
FIG. 2 through FIG. 6 are views, on a reduced scale, of the various positions assumed by the flow sensing portion of the device of FIG. 1 in response to various sequences of rotation and fluid flow.
Figure 3:
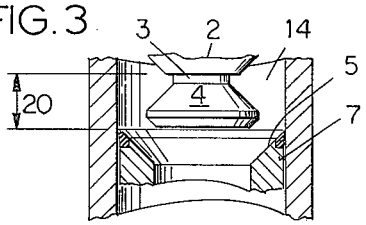

In FIG. 2, which shows valve member 4 and the upper portion of actuator 7, no fluid is flowing downwardly in bore 14 and actuator 7 is at the upper limit of its travel. Member 4, when in engagement with valve seat or surface 5, will resist downward flow of fluid. In FIG. 3, fluid is moving downwardly in bore 14 and has urged actuator 7 downwardly, separating surface 5 and member 4. Valve member 4 has been stopped in the high position by the rotation sensor and the opening between surface 5 and member 4 is sufficient to accept the flow of fluid from bore 14 in housing 1 to the bore 13 of the actuator. In this situation the distance 20 represents the distance from the top of the actuator to the lower end of the sensor housing. Devices controlled by this embodiment of this invention will normally be two-position devices and will not be actuated by a downward movement of actuator 7 of this amount.

Figure 4:
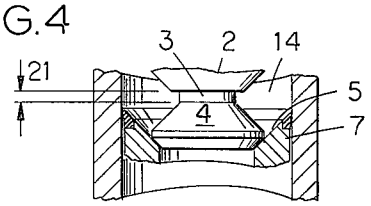

In FIG. 4, there is no flow of fluid down bore 14. The position of member 4 and surface 5 is the usual starting position and hence is the same as that for FIG. 2. The distance 21 shows the normal no-flow position of member 4 relative to the lower end of the rotation sensor housing. Assume that the drill string is rotating and the rotation sensor 2, by processes to be described later, has released shaft 3 to allow member 4 to follow surface 5 a preselected distance as the actuator moves downwardly when the flow of fluid is initiated in the drill string.

Figure 5:
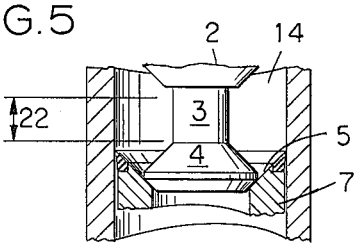
Figure 6:
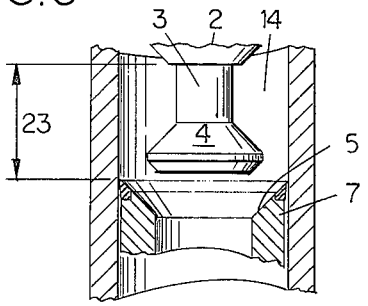

As shown in FIG. 5, the initiation of downward flow of fluid in the drill string bore 14 has urged the actuator downward, but because shaft 3 has been released (as described for FIG. 4) for downward movement, the member 4 and surface 5 will not begin to separate until the distance 22 is traveled by member 4 from the starting position at which point shaft 3 has reached the limit of downward travel. As shown in FIG. 6, the actuator has been moved downwardly to a position such that it is distance 23 from the lower end of the sensor housing. Comparing the distance 23 with the distance 20 of FIG. 3 shows a greater movement of the actuator. The increase in travel represents approximately the distance 22 of FIG. 5 assuming approximately the same flow of drilling fluid in both cases. In the lower position shown for the actuator in FIG. 6, the device controlled by actuator 7, by means of extension 12, will have been actuated.

Figures 7A, 7B:
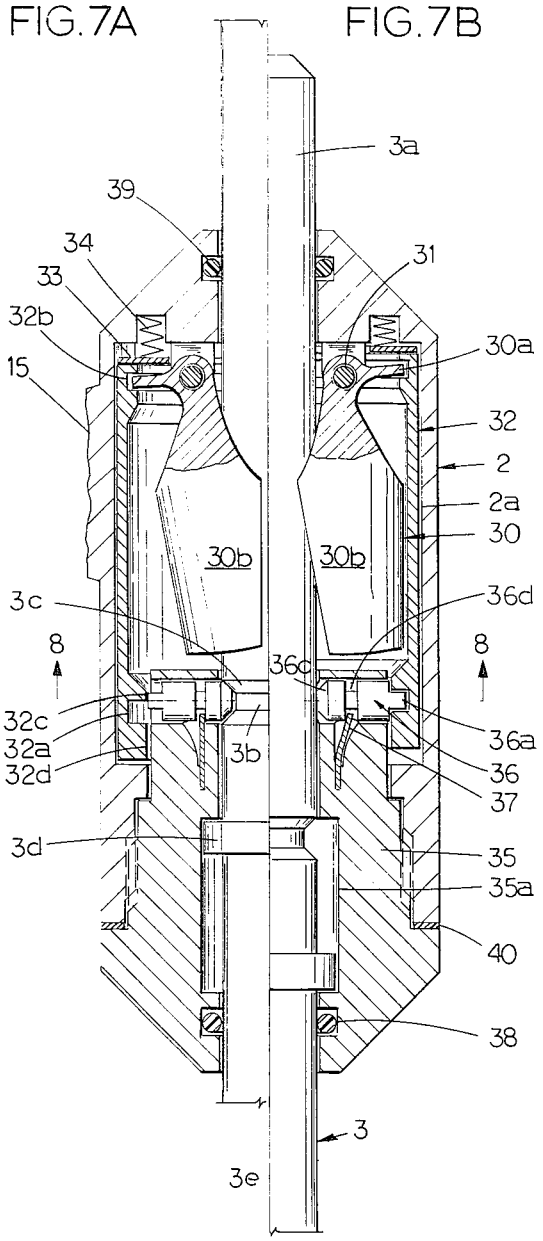
FIG. 7A is a view in section of the left half of the rotation sensor of FIG. 1 with the output shaft in the upper position.
FIG. 7B is a view in section of the right half of the rotation sensor of FIG. 1 with the output shaft in the lower position.

The rotation sensor shown in FIG. 1 is further explaind with reference to FIGS. 7A and 7B. Control shaft 3 extends axially through body 2. Shaft 3 has an upper limit of travel shown on the left side as FIG. 7A. The right side, FIG. 7B, shows shaft 3 at the lower limit of travel. Shaft 3 may be urged upwardly by spring 9 through the contact between surface 5 of FIG. 1 with member 4 attached to shaft 3 and it is urged downwardly by its weight and any downward flow of drilling fluid past member 4.

When shaft 3 is urged to the upper position, latch dogs 36 are urged radially inward by springs 37 so that surfaces **36*c* are engaged with groove 3*b*. If shaft 3 is then urged downwardly, bevel surface 3*c* of groove 3*b* will urge dogs 36 radially outward. If the dogs move radially outward and do not coincide with groove 32*a*, tang 36*a* will hit surface 32*c* which will not allow enough movement for the interfering surface 36*c* to clear the groove 3*b*, and shaft 3 will not move downwardly. If, however, when shaft 3 is urged downwardly, sleeve 32 is in such axial position that groove 32*a* is aligned with tang 36*a*, dog 36 may move radially outward as shown in FIG. 7B and the dogs will clear shaft 3, groove 3*b* and shaft 3 will move downwardly. When tang 36*a* is engaged in groove 32*a*, sleeve 32** cannot move axially, and subsequent rotational speed changes do not alter the position of the sleeve.

Flyweights 30 comprise masses **30*b* pivotable about pivot pins 31, the pins being attached to body 2. Flyweights 30 have radially projecting levers 30*a* which engage annular groove 32*b* of sleeve 32. When the body 2 is not being rotated by the drill string, flyweight masses 30*b* move radially inward as sleeve 32 is urged downwardly, biased in that direction by springs 34 acting through annular ring 33 against the upper end of the sleeve. With the sleeve near the lower limit of its travel, groove 32*a* is misaligned with tang 36*a* as shown in FIG. 7A**.

When the drill string is rotated, body 2 rotates and the flyweights rotate about the axial centerline of the device. Flyweight masses **30*b* are urged radially outwardly by centrifugal force. As the masses move radially outwardly, pivoting about pins 31, levers 30*a* move upwardly and, through engagement with grooves 32*b*, urge sleeve 32 upwardly. At the upper limit of the travel of sleeve 32, groove 32*a* is aligned with tangs 36*a*. Dogs 36 may now move radially outwardly if a downward force is exerted on shaft 3**.

As shown in FIGS. 7A and 7B, spring 34 is of such strength, relative to weights **30*b*, that sleeve 32 tends to move upward at higher rotational speeds and downward at lower rotational speeds, thus shaft 3 is free to move downwardly when the device is rotating above a preselected speed but is retained in the upper position when the device is rotating below the preselected speed. This arrangement may readily be reversed during assembly by using a thicker washer 40 to move the member 35 downward relative to the pins 31. This will align tang 36*a* with groove 32*a* at lower rotational speed and misalign the groove at higher rotational speed. When the shaft 3 is held in its upward position by high rotational speed, tangs 36*a* will hit surface 32*d* of sleeve 32 instead of surface 32*c* as previously described. By changes in washer 40, then, shaft 3** may be held upward at high rotational speeds and released for downward travel at low rotational speed in contrast to the opposite effect hereinbefore described.

In the actuation of such devices as valves with the apparatus of this invention, the choice of using the arrangement of retaining shaft 3 upward at higher rotational speeds or retaining shaft 3 upward at low rotational speeds is a matter of designer's preference. The device of FIG. 7A and 7B, however, is more stable in the position as shown in FIG. 7B, because shaft 3 has to be moved upwardly by external force to enable the rotation sensor to control the shaft. As shown in FIG. 7A, however, with a downward force on shaft 3 and smooth surfaces in contact between tang 36*a* and 32*c*, an increase in the pipe string rotational rate, urging masses 30*b* outwardly, could result in the downward movement of shaft 3 after the flow of fluid down the pipe string is well established. This belated downward movement of shaft 3, if actuating a rotor lock, for instance, could be destructive to a rotating down hole motor. The embodiment which releases shaft 3 at low rotational speed would be used to lock a down hole motor.

In many instances, however, it may be desirable for the rotation sensor to cause a preferred action when drill string rotation rate is changed whether the flow of drilling fluid is just being initiated or is well established. This can be done from the upper position of shaft 3. By design, the relationships of mass 30*b*, surface friction between dogs 36 and the surface of sleeve 32 in contact with the dogs, and the contour of surfaces 3*c* and 36*c*, may be such that shaft 3 can be released for downward movement if the rotational situation that retained shaft 3 in the upper position is sufficiently altered.

The seals 38 and 39 separate the fluid from within the body 2 from the fluid outside the body. A flexible membrane (not shown) may be used as a hydrostatic compensator to equalize pressure within the body with the pressure outside the body.

In relation to the device of FIG. 1, two principal axial positions of actuator 7 have been described. Four positions having potential use should be described. The four positions can be defined as upper position — low flow, upper position — high flow, lower position — low flow and lower position — high flow. The upper and lower positions are determined by the position of member 4 which is further determined by the rotation sensor. The low flow and high flow positions are determined by the separation of surface 5 and member 4 which, in turn, is related to the flow of drilling fluid through the drill string.

Figure 9:
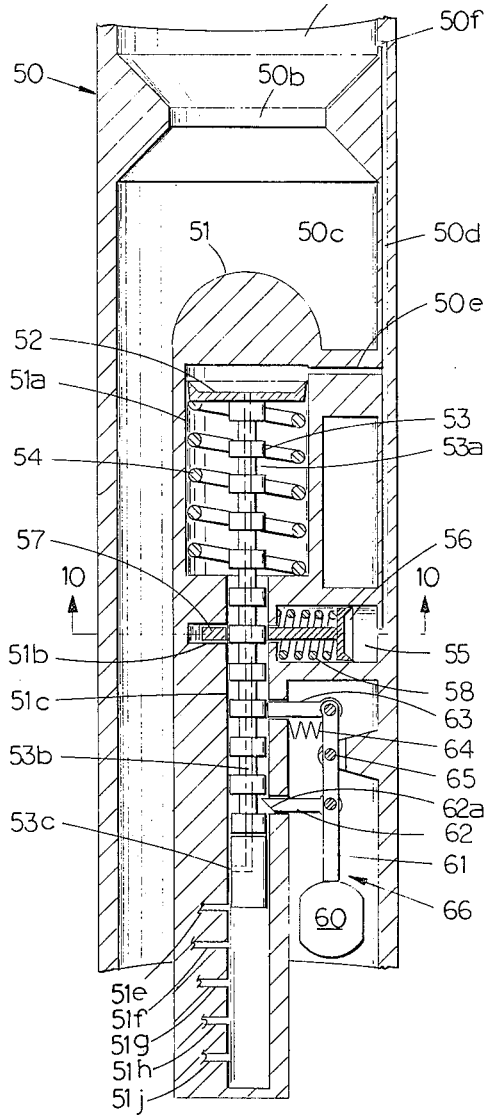
FIG. 9 is a longitudinal sectional view of an alternate embodiment of this invention to provide a wider choice of actions down hole.
Figures 8A, 8B:
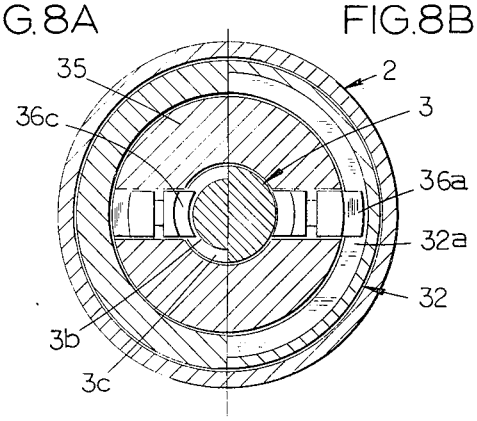
FIG. 8A is a view of the device of FIG. 7A taken along line 8—8.
FIG. 8B is a view of the device of FIG. 7B taken along line 8—8.
Figure 10:
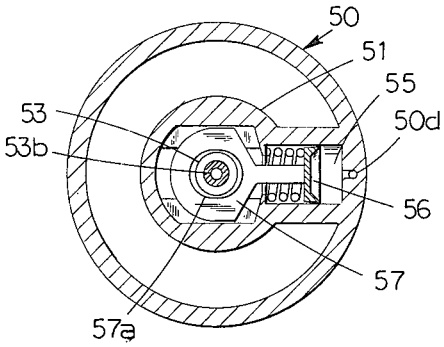
FIG. 10 is a sectional view taken along line 10—10 of FIG. 9.

The device of FIG. 9 provides a number of choices of actions to be carried out down hole by manipulation of the rate of flow of drilling fluid down the drill string bore and the rate of rotation of the pipe string. Subsequent description will be related to drill strings but is not to be regarded in a limiting sense.

Housing 50 is part of the drill string being attached above by means not shown to the upwardly extending drill string and being attached below by means not shown to the downwardly extending drill string.

As drilling fluid flows downwardly in bore 50*a* through orifice 50*b*, a pressure drop, proportional to the flow rate, exists across the orifice and enters openings 50*f*, channel 50*d*, channel 50*e* and cylinder 51*a* above piston 52. The pressure above piston 52 urges it to move downwardly an amount proportional to the pressure above the piston and hence an amount proportional to the flow of fluid down the drill string.

The downward movement of rod 53 is limited by bore 57*a* in slide lock 57. Slide lock 57 is positioned by fluid pressure conducted from opening 50*f* by way of channel 50*d* and cylinder 55 to piston 56. Piston 56 is urged to the left by the fluid pressure and the right by spring 58. At a particular range of pressures across the orifice, bore 57*a* is centered and rod 53 can move up or down. At other pressures across the orifice, piston 56, and hence bore 57*a*, will be more left or right and in such positions will engage grooves 53*a* on rod 53 and prevent axial motion. The selection of spring 58 and spring 54 is such that while bore 57*a* permits rod 53 to move axially, the range of pressure during which such movement is permitted is such that rod 53 will move axially an amount sufficient to bring port 53 in registry with all channels, 51*e* through 51*j*, each in turn.

Rotation sensor 66 is situated to control the axial movement of rod 53 in response to the rotational situations imposed upon the drill string, housing 50 and the sensor. Flyweight 60, attached to lever 61, is urged outward radially by centrifugal force when the drill string is rotating. Flyweight 60 is urged radially inwardly by spring 64 acting on lever 61 on the opposite side of pivot 65 from flyweight 60. Sear 63 is moved inwardly by high rates of drill string rotation and moved outwardly by low rotational rates.

Many options exist for shaping and placement of sears 62 and 63. As shown in FIG. 9, at a particular rotation rate both sears will clear rod 53. At a lower rotational rate sear 62 will move inwardly and engage the grooves in rod 53. At higher rotation rates sear 63 will move inwardly to prevent axial movement of rod 53. In operation, then, a preselected drill string rotational rate is established to clear both sears. Th drilling fluid flow rate is then adjusted to position rod 53 such that port 53*c* is in registry with a selected channel of the 51*e* through 51*j* group. A change in rotation rate, then, brings a sear into a groove 53*a*. The drilling fluid flow rate can then be increased to any preferred operational level. Beyond a certain drilling fluid flow rate, member 57 will move left to lock rod 53 in position. As long as the drilling fluid flow rate remains high enough to lock rod 53 with member 57, the rotational rate will no longer influence the position of rod 53. The change drilling fluid flow rates to low values without altering the position of rod 53, the drill string may be rotated at a speed to move sear 63 into a groove 53*a* to lock the rod. The drilling fluid flow rate may then be reduced, say to zero, to make connections, so that member 57 moves right to lock rod 53. Rotation of the drill string, then, may be changed to any value including zero to make connections, with no influence on rod 53.

As shown in FIG. 9, sear 62 has bevel 62*a* which will cause the sear to allow rod 53 to move upwardly when sear 62 is in a position to prevent downwardly movement of rod 53. This is optional but permits rod 53 to be moved upwardly to the initial point if lock 57 does not interfere. This permits easy cancellation of erroneous movement of rod 53 and will reset the device to the initial position any time rotation is stopped before the flow of drilling fluid is reduced from a high rate to a low rate. As an optional arrangement, sears 62 and 63 are of such length that they form an escapement mechanism such that rod 53 cannot move freely downwardly at any position of flyweight 60. To advance rod 53 downward one step, then, flyweight 60 must make one cycle outwardly and inwardly. Drill string rotation, therefore, must be increased and decreased between selected ranges once to make one step downward of rod 53 with a flow rate established to urge piston 52 downwardly and to generally center member 57. With the escapement mechanism, bevels such as 62*a* can be placed on both sears for easy cancellation or on neither sear so that cancellation, movement of rod 53 upwardly, is accomplished by repeatedly cycling the rotation of the drill string between preselected limits with the flow rate within a preselected range.

The device of FIG. 9 in response to the drilling fluid rate and drill string rotational rate manipulations hereinbefore described, provides fluid pressure to one of the output channels of the group 51*e* through 51*f*. The pressure is conducted from the area above piston 52 through duct 53*b* to port 53*c*. The fluid pressure from the group of output channels may be used for any suitable purpose. One such use is the actuation of preferred orienting members in the device of my copending application Ser. No. 370,927 filed June 18, 1973.

Figure 11:
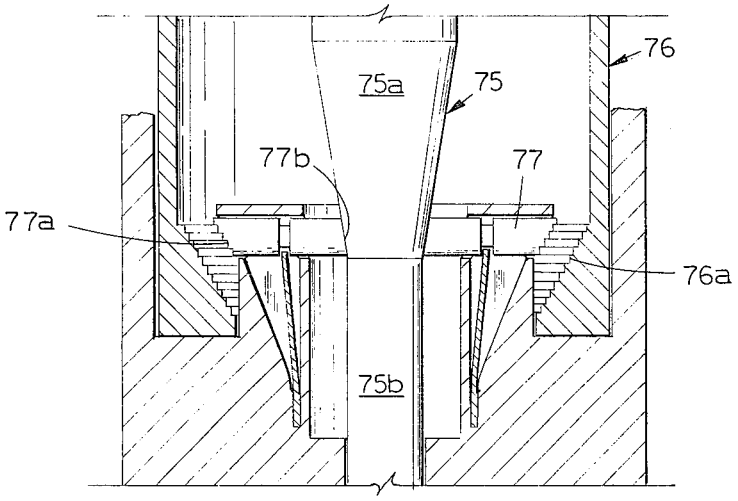
FIG. 11 is a sectional view of an alternate arrangement of the principal elements of the device of FIG. 7A and 7B to provide means to move an actuator an amount proportional to the pipe string rotation rate.
Figure 12:
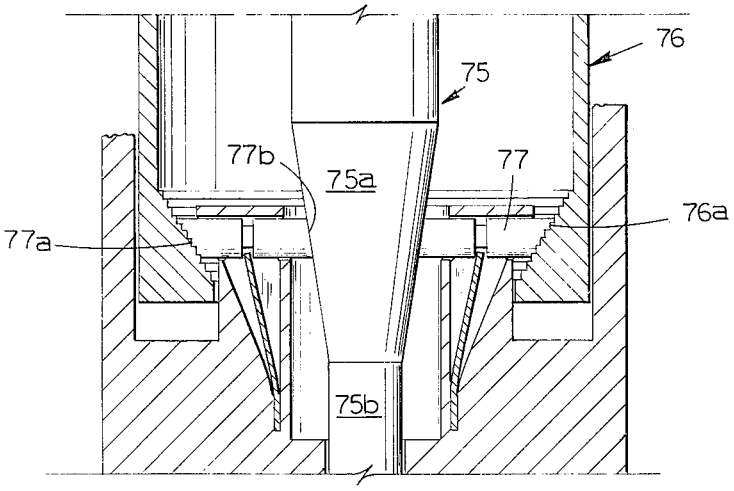
FIG. 12 is a sectional view of the device of FIG. 11 with some parts in different positions.

In an alternate embodiment, the device of FIG. 7A and 7B is converted to cause rod 3 to move downwardly when drilling fluid flow rate is initiated a distance proportional to the rotational rate of the drill string at the time the flow is initiated. As shown in FIG. 11, sleeve 32 is replaced by sleeve 76. Rod 3 is replaced by rod 75. Dogs are replaced by position transfer members 77. No other changes are required.

As in the case of the device of FIG. 7A and 7B, sleeve 76 is movable vertically and is held in a vertical position that is related to the drill string rotation rate. Grooved conical surface 76*a* inside sleeve 76 matches surface 77*a* on the outer ends of members 77. Before fluid flow begins, rod 75 is in the upward position shown, having been moved to that position by spring 9 of FIG. 1. Drill string rotation is stabilized at a preselected rate to accomplish a desired result down hole. Sleeve 76 assumes a vertical position established by processes previously described. When the flow of drilling fluid is started, rod 75 moves downwardly as urged by processes described in connection with FIG. 1. This causes conical surface 75*a* to urge members 77 radially outwardly. The outward movement of members 77, normally urged inwardly by spring 78, causes surface 77*a* to engage conical surface 76*a*. This engagement stops the outwardly movement of member 77 and this in turn stops the downwardly movement of rod 75 because the conical surface 75*a* will be in engagement with the now immovable member 77. Rod 75 will then be stopped in an axial distance from the starting position that is proportional to the drill string rotation rate at the time drilling fluid flow was initiated.

Because rod 75 urges members 77 radially outwardly engaging surfaces 77*a* and 76*a*, sleeve 76 cannot move. The rotational rate of the drill string can then be changed to any value as long as fluid flow is sustained without changing the position of rod 75.

The device of FIG. 11, then, used in conjunction with the apparatus of FIG. 1 can be used to apply axial positioning force achieved by the available drilling fluid pressure acting on area 5 of FIG. 1 to move a down hole drilling device being actuated an amount proportional to the rotational rate of the drill string at the time fluid flow is initiated.

From the foregoing, it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and sumcombinations. This is contemplated by and is within the scope of the claims.

As many possible embodiments may be made of the apparatus of this invention without departing from the scope thereof, it is to be understood that all matter herein set forth or shown in the accompanying drawings to be interpreted as illustrative and not in a limiting sense.

The invention having been described, what is claimed is:

1. A method for selectively actuating downhole devices carried by a pipe string comprising; the establishment of a preselected rotation rate of said pipe string to select the function, for subsequent execution, to be carried out down hole, then changing the rate of flow of fluid through said pipe string from one preselected rate to another to cause execution of the function, then changing at least one of said rates to another value to secure the selected function against further change.

2. A method for selectively actuating down hole devices carried by a pipe string comprising; the establishment of a preselected rate of flow of fluid through said pipe string to select the function, for subsequent execution, to be carried out down hole, then changing the rotation rate of said pipe string to cause the execution of the selected function then changing at least one of said rates to other values to secure the function selector against further changes.

3. A method for selecting one of two choices of actions to be carried out by a down hole device carried by a pipe string comprising; the establishment of a flow rate of fluid through the pipe string above a preselected rate before establishing a pipe string rotation rate above a preselected minimum, to select a first choice, the second of the choice of two actions being selected by establishing a rotation rate of the pipe string above a preselected rate, before establishing a rate of flow through the pipe string above a preselcted rate.

4. Apparatus for controlling a down hole device carried by a pipe string comprising; means for restricting the flow of fluid through the pipe string to create a pressure differential across said restricting means when fluid is pumped through the pipe string, means responsive to the pressure differential to actuate a down hole device, and means responsive to rotation of the pipe string to control said actuating means.

5. The apparatus of claim 4 in which said flow restricting means includes a member located in the pipe string to restrict the flow by the member having an opening through which at least a portion of the fluid in the pipe string can flow and a valve member, responsive to the rotation rate of said pipe string, for reducing the size of the opening to control the pressure differential across the member.

6. The apparatus of claim 5 in which said means responsive to the pressure differential to actuate a device includes means for mounting the member for movement between first and second positions, means mounting said valve member for movement with said member to restrict the opening as said member moves between the positions, resilient means urging the member toward the first position, and means for actuating said device when said member is in the second position.

7. The apparatus of claim 6 in which said means for controlling the actuating means includes means to hold said valve member from movement with said member to thereby allow fluid to flow through the opening when said member moves toward the second position to decrease the pressure differential across said member sufficiently for said resilient means to hold said member away from the second position and means responsive to rotation of the pipe string before fluid is pumped through the pipe string to release the holding means to allow said valve member to move with said member far enough for said member to move to the second position.

8. The apparatus of claim 5 in which said means for controlling the actuating means includes means to hold said valve member from movement with said member to thereby allow fluid to flow through the opening when said member moves toward the second position to decrease the pressure differential across said member sufficiently for said resilient means to hold said member away from second position and means responsive to rotation of the pipe string before fluid is pumped through the pipe string to actuate said holding means.

9. Apparatus for actuating a downhole device carried by a pipe string comprising; a piston member movable longitudinally of the drill string in response to a differential pressure across said piston, said piston having an opening therethrough through which fluid pumped down the drill string can flow, a valve element for restricting the opening, means mounting said valve element for movement with said piston while restricting the opening, means for holding said valve element from such movement and means responsive to a preselected rotation rate, including zero, of the drill string before fluid flow is increased above a preselected value to release said holding means to allow said piston and valve member to move downwardly to actuate the device.

10. Apparatus for actuating a downhole device carried by a pipe string comprising; a flow restricting member with an opening therethrough located in the pipe string and movable within the pipe string between a first position where the downhole device is not actuated and a second position where the device is actuated, resilient means urging said member toward the first position, a valve member for restricting the opening when said flow restricting member is in the first position and movable with said member to keep the opening closed sufficiently while said member moves to the second position to provide sufficient pressure differential across said member to move it to the second position over the opposing forces, means for holding said valve member from moving with said flow restricting member to thereby allow fluid to flow through the opening so that the differential pressure across said member during regular fluid flow will not be sufficient to move said member to the second position, and means responsive to the rotation rate of the pipe string before fluid is pumped through the pipe string above a preselected rate for controlling the releasing of said holding means.

11. Apparatus for actuating a down hole device carried by a pipe string comprising; an actuating member movable between a first position where the device is not actuated and a second position where the device is actuated, piston means responsive to a pressure differential to urge said actuating member from the first to the second position to actuate the device, means for creating a pressure differential when fluid is pumped through the pipe string to act on said piston means, and means responsive to a preselected rotation rate, including zero, of the pipe string to control the movement of said actuating member to the second position.

12. Apparatus for controlling a down hole device carried by a pipe string comprising; means to detect the rotation rate of the pipe string, means to detect the rate of flow of fluid through the pipe string, an actuating member movable to a position related to the rotation rate, means to move said actuating member when the flow rate is at a preselected value to a position related to the rotational rate at the time of the movement and means to hold said member in said position when the rate of flow and the rotation rate is changed after movement of said member to a position related to the rotation rate at the time of the movement, the position of said member to determine the action to be carried out by the down hole device.

13. Apparatus for controlling a down hole device carried by a pipe string comprising; means to detect the rate of flow of fluid through the pipe string, means to detect the rotation rate of the pipe string, means to actuate and retain in that state of actuation a function selector in response to the rotation rate of the pipe string when the flow of fluid through the pipe string is changed from one preselected value to another, and means to secure said function selector to prevent change to different functions when the pipe string rotation rate and rate of flow of fluid through the pipe string is changed within preselected limits after said function selector has been actuated.

14. The apparatus of claim 13 further provided with means to change said function selector in order to change the functions being carried out by said downhole assembly in response to preselected manipulations of the rate of flow of fluid through the pipe and rate of rotation of the pipe string.

15. Apparatus for controlling a down hole device carried by a pipe string comprising; means to detect the rate of flow of fluid through the pipe string, means to actuate a function selector in response to the flow rate detected, means to detect the rotation rate of the pipe string and means to cause said means to actuate and retain in that state of actuation said function selector when the pipe string rotation rate is changed from one preselected value to another preselected value.

16. The apparatus of claim 15 further provided with means to retain said means to actuate a function selector in the function selection situation in which it is actuated until a preselected combination of flow rate of fluid through the pipe string and rotation rate of the pipe string is established and means to change the situation of said actuator to change the function to be carried out by the down hole device in response to the establishment of said preselected combination of flow rate and rotation rate.

17. The apparatus of claim 16 in which said means to change the function selection situation of the function selector actuator comprises means to move said actuator from one function related position to another each time the rotation rate is changed to and from one preselected value to another while the flow rate is maintained within a preselected range, including zero.

18. The device of claim 15 further being provided with means to return the function selector actuator means to an initial starting position when a preselected flow rate of fluid through said pipe string and a preselected rotation rate of said pipe string is established.

* * * * *